United States Patent [19]

Tyler et al.

[11] Patent Number: 5,060,126

[45] Date of Patent: Oct. 22, 1991

[54] COLOR WHEEL FOR LIGHTING DEVICES

[76] Inventors: Thomas Tyler, Rd 3, Box 349, Cronk Rd., Wallkill, N.Y. 12589; John F. Luk, 55-02 96th St., Corona, N.Y. 11368; Roger Pujol, 150 Rinaldi Blvd., (Apt. 9D), Poughkeepsie, N.Y. 12601

[21] Appl. No.: 556,752

[22] Filed: Jul. 23, 1990

[51] Int. Cl.[5] ..... F21V 9/00

[52] U.S. Cl. ..... 362/277; 362/293; 362/322; 362/455; 359/889; 359/892

[58] Field of Search ..... 362/2, 293, 277, 280, 362/281, 282, 283, 433, 455, 456, 457, 319, 322, 323, 311, 806; 350/311, 313, 315, 316, 318; 40/431

[56] References Cited

U.S. PATENT DOCUMENTS

| | | | |
|---|---|---|---|
| 1,577,854 | 3/1926 | Vinageras | 362/293 |
| 2,029,863 | 2/1936 | Earle | 362/293 |
| 3,247,609 | 4/1966 | Hayes et al. | 40/431 |
| 4,745,531 | 5/1988 | Leclereg | 362/293 |
| 4,777,566 | 10/1988 | Lowell et al. | 362/283 |
| 4,800,474 | 1/1989 | Bornhorst | 362/293 |

*Primary Examiner*—Stephen F. Husar
*Assistant Examiner*—D. M. Cox
*Attorney, Agent, or Firm*—Lackenbach Siegel Marzullo & Aronson

[57] ABSTRACT

Color wheel for lighting fixture, which includes a polygonal metal plate, which has slotted metal bars seated on the side edge of the polygonal plate with rectangular glass plates, e.g. dichroic filters adhesively held in the slots of the metal bars spaced. The glass plates are not in direct contact with the metal bars and are spaced close to each other, but not in contact, in a peripheral array.

8 Claims, 3 Drawing Sheets

FIG. 1
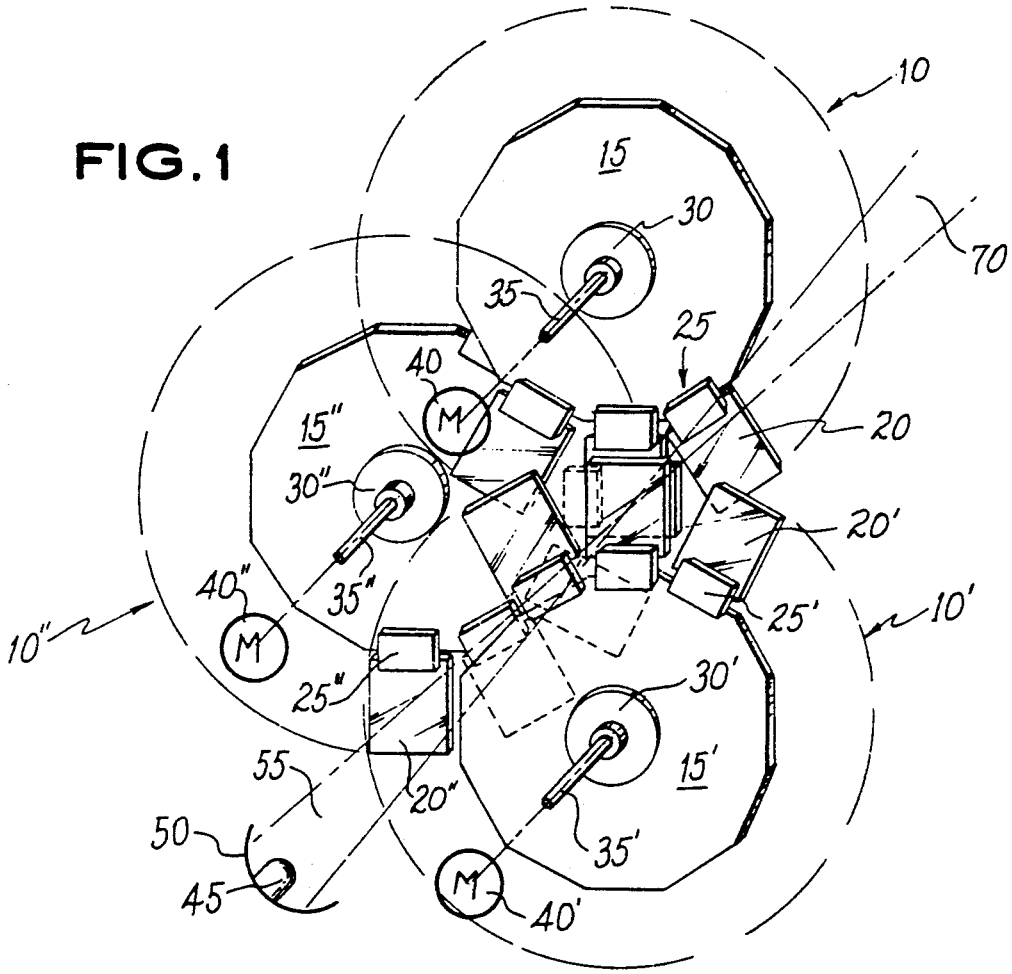
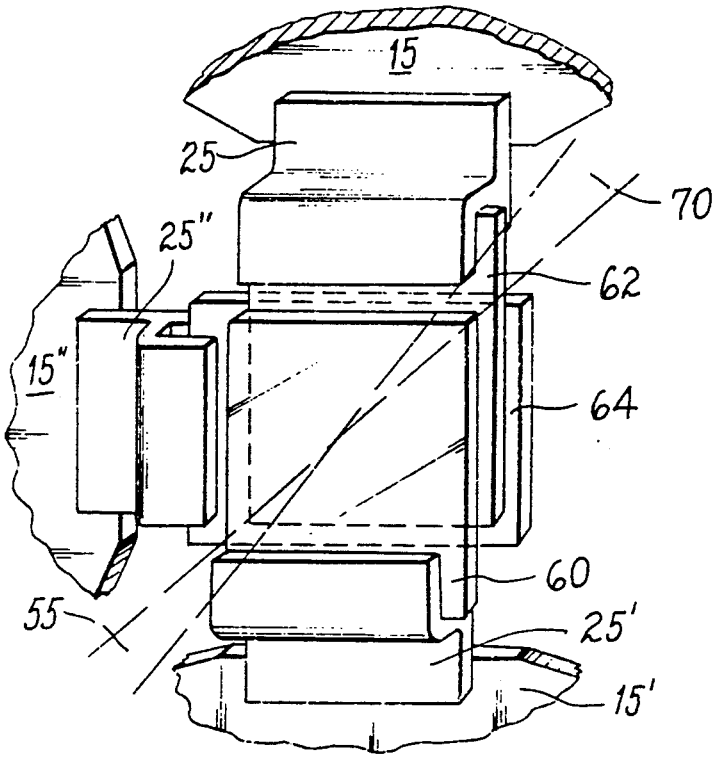
FIG. 1A

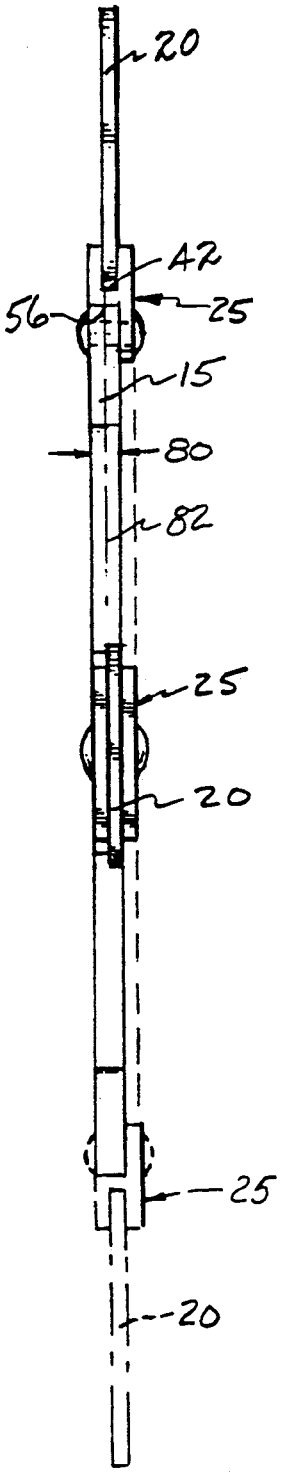
FIG. 4
FIG. 6
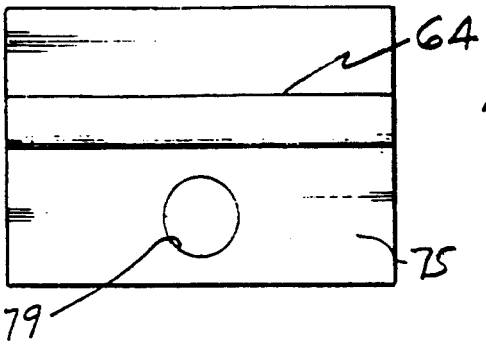
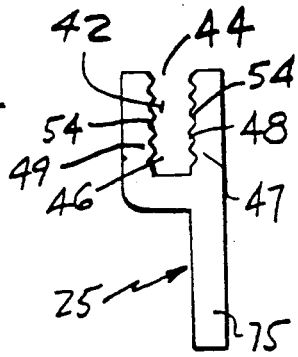
FIG. 5
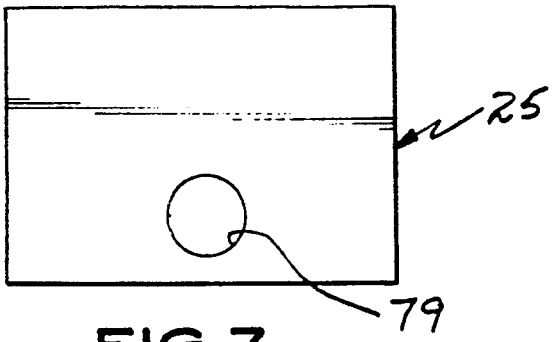
FIG. 7
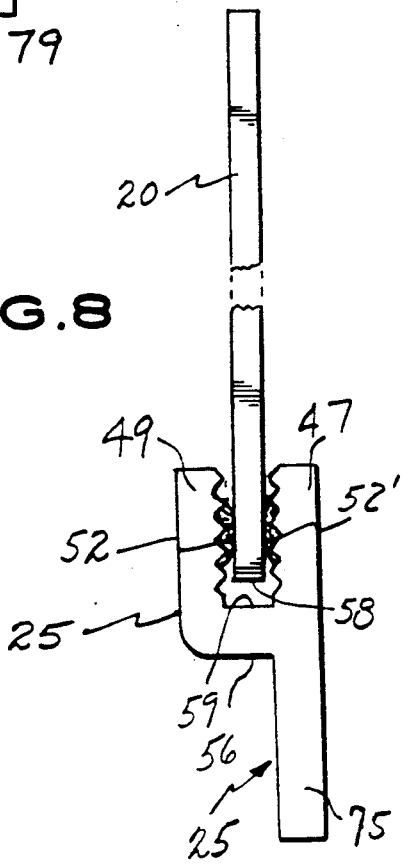
FIG. 8

COLOR WHEEL FOR LIGHTING DEVICES

FIELD OF THE INVENTION

This invention relates to a rotatable color wheel for use with lighting equipment designed to provide multiple colors of light.

BACKGROUND OF THE INVENTION

Lighting equipment for producing colors of light for stage and concert lighting is known to the art, for example, as described in U.S. Pat. Nos. 4,392,187 and 4,800,474, both of which disclose the use of color wheels which comprise a rotatably mounted peripheral array of glass filters positioned so that a light beam can pass through filters of one or more color wheels. The filters, (e.g. dichroic filters), are selected to have various light transmission characteristics, i.e. different cutoff wavelengths, so that a variety of colors can be produced from a light beam passed through one or more filters positioned on peripherally overlapping color wheels. The color wheel of U.S. Pat. No. 4,342,187 comprises a plurality of glass filters mounted in peripherally spaced apart apertures; the color wheel of U.S. Pat. No. 4,800,474 includes a hub comprising two concentric metal plates of different diameters which are joined together so that a step is provided for the proper positioning of each of a plurality of laterally contiguous glass filters of trapezoidal shape. Also disclosed in U.S. Pat. No. 4,800,474 is the use of annular metal bands to hold the filters in place. The above-described color wheel arrangements of the prior art have been successful, but in the case of the arrangement of U.S. Pat. No. 4,392,187, there is considerable blanking due to opaque interfering spacing between filter apertures in the color wheel and significant manufacturing expense. In the arrangement of U.S. Pat. No. 4,800,474, the positioning of glass filters on a metal step, the laterally contiguous positioning of the glass filters, and the use of metal bands leads to thermal and mechanical stress of the filters and makes installation of the replacement of individual glass filters tedious and expensive. Accordingly, there is a need for a color wheel in which glass filters can be readily, individually installed and replaced and in which mechanical and thermal stress is reduced.

SUMMARY OF THE INVENTION

In accordance with the present invention, a color wheel is provided comprising a metal plate with planar opposed surfaces in the shape of a regular polygon, i.e. equal sides and equal central angles, preferably at least ten sides so that spacing between the filters can be minimized. A collar means is fixed to the plate surrounding a central opening therein, and is adapted to engage a shaft passing through the central opening for rotation of the polygonal plate. A plurality of slotted metal bars of relatively short length, i.e. about ½ to ¾ of the length of a side edge of the metal plate are provided; these bars are flat bottomed and have open sides and an open top and are respectively, centrally, seated on respective side edges of the polygonal metal plate with the flat bottom portions of the metal bars contacting the metal plate at its respective side edges. The slots of the metal bars have their top openings facing outward from the central opening of the metal plate and are in alignment with the metal plate. Each metal bar has an integral metal tab extending in a direction away from its open top, toward the central opening of the metal plate and in close contact with the metal plate at a selected planar surface thereof. Means for mechanically engaging each metal tab to the metal plate are provided so that each slotted metal bar is firmly attached to the polygonal metal plate. A plurality of equally sized, spaced apart, rectangular glass plates with opposed planar surfaces are respectively arranged in the slots of the metal bars, with an edge thereof parallel to an adjacent side edge of the polygonal metal plate; the glass plate is spaced from all of the adjacent portions of the metal bar and is partially surrounded at a region adjacent an edge portion by the side walls and bottom of the slot within which it is arranged. Adhesive means are provided to attach a portion of each of the opposed planar surfaces of each glass plate to the side walls of the slot of the metal bar within which it is arranged. In a preferred embodiment of the present invention, the glass plates are all of the same size, and closely laterally adjacent, but not in contact, and the metal bars are all of the same size and shape. The color wheel of the invention is less subject to thermal and mechanical stress between glass and metal and the glass plates can be individually mounted in respective metal bars and the metal bars can then be separately mechanically fixed to the polygonal metal plate. This enables simple assembly and replacement of glass plates on the color wheel. The glass plates of the color wheel are suitably well known, dichroic filters formed from a sheet of thermally resistant or refractory glass, such as pyrex glass or quartz, suitably layer coated by techniques known to the art to separate two, pre-selected, complementary colors out of white light, one of which is reflected, and one transmitted. The glass plates can also be in the form of conventional colored glass of desired hue.

BRIEF DESCRIPTION OF THE DRAWINGS

FIG. 1 is a somewhat schematic perspective view of a lighting device utilizing rotatable color wheels with glass plates, e.g. filters or colored glass, adapted to be positioned to receive a beam of light and transmit a portion of the spectrum thereof.

FIG. 1(A) is an enlarged fragmentary perspective view of the overlapping color wheel portion of FIG. 1.

FIG. 4 is a side elevation view of the color wheel of FIG. 2.

FIG. 5 is a side elevation view of one of the plurality of peripheral metal bars shown in the color wheel of FIG. 2.

FIGS. 6 and 7 are, respectively, front and rear views of the metal bar of FIG. 5 and FIG. 8 shows the metal bar of FIG. 5 in adhesive engagement with a glass plate in accordance with the present invention.

DETAILED DESCRIPTION OF THE INVENTION

Figure 2:
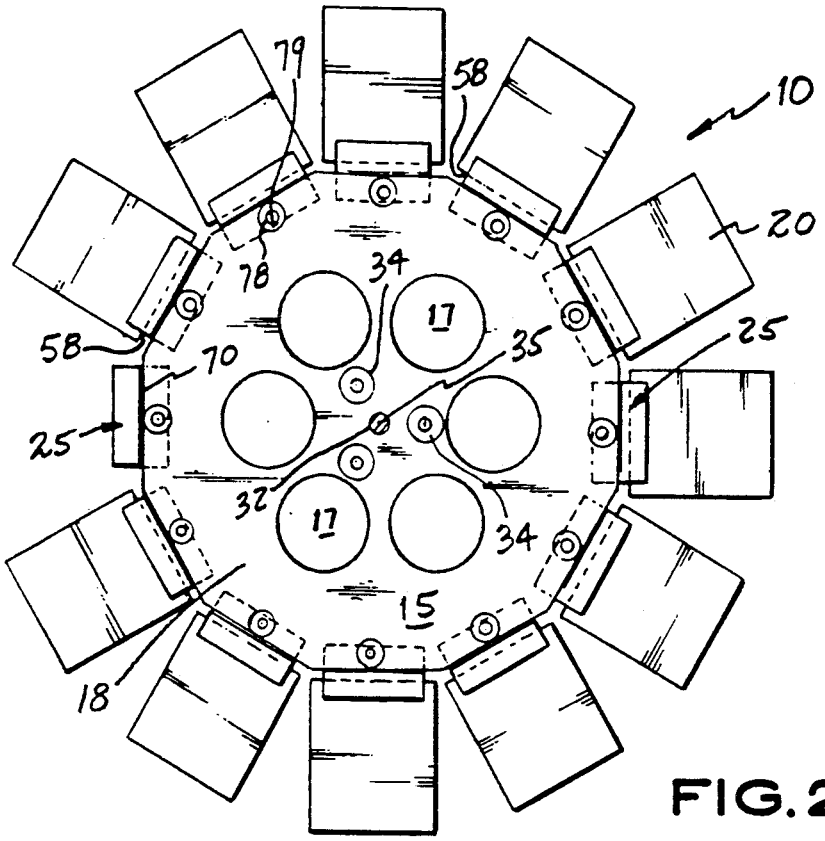
FIG. 2 is an elevation view of one planar side of a color wheel in accordance with the present invention.

With reference to FIG. 1, three color wheels in accordance with the present invention are shown at 10, 10' and 10'', each comprising regular, polygonal metal plates 15, 15' and 15'' having respective peripheral arrays of closely adjacent glass plates illustrated at 20, 20' and 20''. The glass plates 20, 20' and 20'' are arranged in slotted metal bars 25, 25' and 25'', which engage glass plates 20, 20′ and 20″, as described in more detail herein below. Each polygonal plate 15, 15′, and 15″ has a collar 30, 30′ and 30″ affixed thereto for engagement to a rotatable shaft 35, 35′ and 35″ suitably driven by respective step-motors indicated schematically at 40, 40′ and 40″. A white light source is shown at 45 with a focusing reflector 50 which projects light beam 55 through glass plates 60, and 62–64 in accordance with known technique, to obtain a predetermined color transmission at 70. Transmission through three glass plates is not a necessary function of a lighting device, and transmission through one or two glass plates can be utilized to obtain a predetermined color transmission by appropriate positioning of blank positions 75, 75′ and 75″ as is well known to the art.

Figure 3:
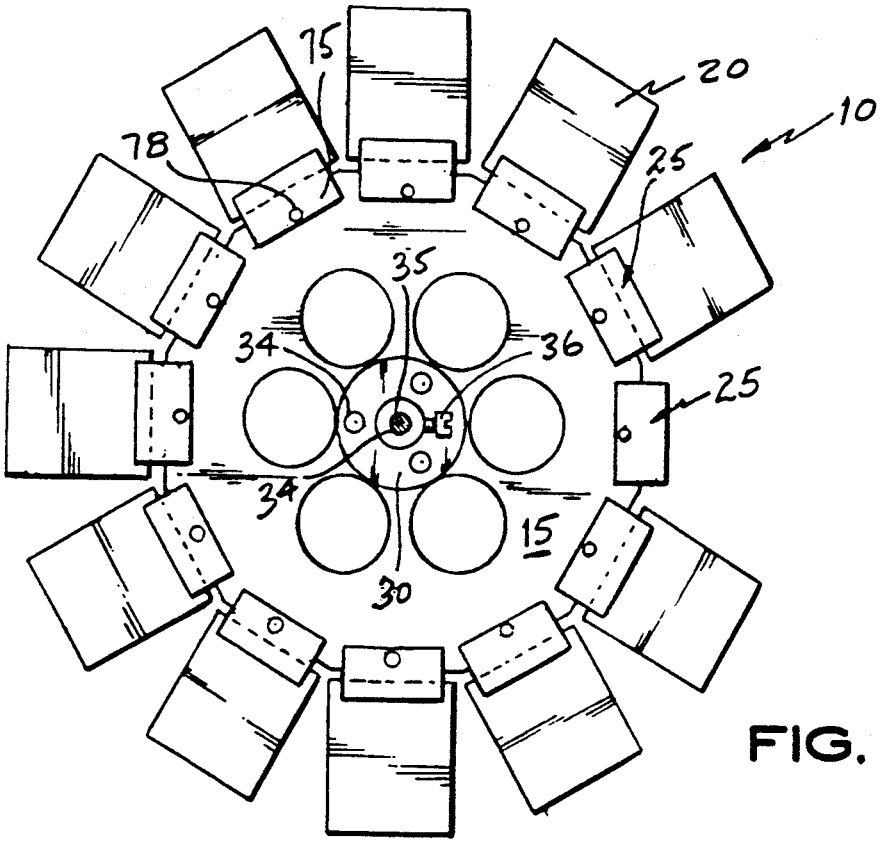
FIG. 3 is an elevation view of the other planar side of the color wheel of FIG. 2.

With reference to FIGS. 2, 3 and 4, twelve sided polygonal plate 15, with opposed planar surfaces 18 and 19, is suitably made of aluminum and is perforated at 17 to reduce weight and enable air cooling. A flanged metal collar, 30, surrounds the central aperture, 32, of plate 15 and is fixed to plate 15 by rivets 34. Shaft 35 of step-motor 40 (shown in FIG. 1) is fixedly engaged to collar 30 by way of set screw 36 and plate 15 can then be rotated to pre-selected positions. Attached to plate 15 are metal bars, 25, also suitably made of aluminum, shown in more detail in FIGS. 5–8. Metal bars, 25 each have a slot or channel 42 which is in alignment with polygonal plate 15. Slots 42 are open at their top 44 and sides 46 to receive glass plates 20 suitably cut from coated sheets of pyrex glass, about 0.05 inch thick, in rectangular shapes of about $1\frac{1}{4}$ by $1\frac{1}{8}$ inch. Each glass plate 20 is affixed to the side walls 48 of a metal bar 25 by an adhesive 52 e.g. commercially available RTV silicone rubber. The side walls 48 are provided with parallel grooves 54 which are parallel to the flat bottomed base 56 of metal bar 25 to enhance engagement of adhesive which is applied as described hereinbelow. The adhesive 25 is applied in a band on both side walls 48, 49 of slot 42, along most or all of its length in order to bind a portion of both sides of glass plate 20 to the sidewalls 48, 49 of slot 42 and provide spacing between the sides of glass plate 20 and the metal bar, 25. Also, glass plate 20 is arranged in slot 42 with an edge 58 parallel to the flat bottom base 56 and the bottom 59 of slot 42 and spaced from the bottom of slot 42, as shown at 62 in FIG. 8. Metal bar 25 can be provided with a scribe mark, 64, to facilitate the proper spacing of glass plate 20 with respect to the bottom of slot 42. The glass plates 20 are centered with respect to metal bars 25 and extend beyond the ends of metal bars 25, which have a length of about $\frac{1}{2}$ to $\frac{3}{4}$ the length of edge 58 of glass plate 20. The slotted metal bar 25 surrounds a portion of glass plate 20, adjacent its edge 58, and is bonded thereto by adhesive tacks 52, 52′ on opposite planar surfaces of glass plate 20. When the glass plates, 20, have been affixed to metal bars 25, as above-described, each assembly is mechanically affixed to polygonal plate 15 by seating the flat bottomed base 56 of each, centrally on repsective side edges 70 of polygonal plate 15. The width of the flat bottomed base 56 is co-extensive with the width 80 of plate 20 as shown in FIG. 4 and the radial axis 82 of plate 15 is common with the longitudinal axis of glass plate 20. The integral metal tabs 75 of the metal bars 25 extend toward the central aperture 32 of plate 15 and closely contact the planar surface 19 of plate 15. Tab 75 is essentially an extension of slot side enclosure 47 and is suitably affixed to plate 15 by means of rivets 78 which pass through holes 79 in tabs 75 and holes 81 in plate 15. The glass plates 20 which overhang their respective gripping metal bars, are arranged laterally, very close, but not in contact, and in operation only slight light leakage occurs as different glass plates are placed in a light beam since a large number of glass plates are used i.e. ten or more. Since the glass plates are not in contact with metal or with each other, the stress resulting from mechanical vibration and thermal expansion are diminished. In the event that a glass plate requires replacement, this is readily accomplished by drilling out the rivet which passes through tab 75, removing the metal bar 25 and replacing it with a new metal bar to which the substitute glass plate is attached in the manner described above.

Although several embodiments of the invention have been illustrated and described herein, it will be understood that the invention is not limited to the embodiments disclosed, but is capable of many rearrangements, modification and substitutions without departing from the scope of the invention.

What is claimed is:

1. A color wheel comprising a metal plate with planar opposed surfaces in the form of a regular polygon having ten or more side edges of equal length and a central opening;

collar means affixed to said plate, surrounding said opening, and adapted to engage a shaft passing through said central opening for rotation of said plate;

a plurality of flat-bottomed, open top and open sided, slotted metal bars each having a length between about $\frac{1}{2}$ and $\frac{3}{4}$ of the length of a side edge of the metal plate, each of said bars being respectively, centrally seated on said side edges with their bottom portions contacting said metal plate and their slots aligned with said metal plate so that the open tops of the metal bars face outwardly from the central opening of said metal plate, each said slotted metal bar, having an integral metal tab portion extending away from the open top thereof and toward the central opening of said metal plate and in close contact with a surface of said metal plate; means for separately mechanically engaging each said metal tab to said metal plate;

a plurality of equal-sized, spaced apart, planar, rectangular glass plates having straight side edges and planar opposed surfaces respectively arranged in a slot of a metal bar with a side edge parallel to an adjacent side edge of said metal plate and spaced from said metal bar;

and adhesive means attaching a portion of each of the opposed planar surfaces of each glass plate, within a slot, to respective metal bars.

2. A color wheel in accordance with claim 1, wherein said glass plates include dichroic filters.

3. A color wheel in accordance with claim 1, wherein said glass plates have deposited layers for filtering of a light beam.

4. A color wheel in accordance with claim 1, wherein said glass plates include a colored glass plate.

5. A color wheel in accordance with claim 1, wherein said slots of said metal bars have grooves which are parallel to the side edge of the glass plate which is arranged therein.

6. A color wheel in accordance with claim 1, wherein said side edges of said glass plates extend outside of the slots of said metal bars so that the glass plates are spaced laterally close to each other, but not in contact.

7. A color wheel in accordance with claim 1, wherein each said separate means for mechanically engaging said metal tabs to said metal plate is removable and replaceable so that each glass plate can be separately removed and replaced.

8. A color wheel comprising a metal plate with planar opposed surfaces in the form of a regular polygon having ten or more side edges of equal length and a central opening;

collar means affixed to said plate surrounding said opening and adapted to engage a shaft passing through said central opening for rotation of said plate;

a plurality of metal bars each having flat bottoms and a channel extending parallel to and co-extensive with said flat bottoms, said channels having substantially parallel side walls with an opening spaced away from said flat bottoms, the side walls of said channel having a plurality of parallel grooves parallel to said flat bottoms, said flat bottoms having a length between about $\frac{1}{2}$ and $\frac{3}{4}$ of that of a side edge of the metal plate and being centrally seated on each of said side edges with said channels aligned with said metal plate, each said metal bar having an integral metal tab portion extending from said flat bottom away from said channel opening and in close contact with the surface of said metal plate;

fastener means for separately, mechanically engaging each said metal tab to said metal plate;

a plurality of equally sized, closely adjacent, but spaced apart, planar, rectangular glass plates having straight side edges and planar opposed surfaces respectively arranged in a channel of a metal bar with a side edge parallel to an adjacent side edge of said metal plate and spaced from said metal bar;

and adhesive means for attaching a portion of each of the opposed planar surfaces of each glass plate, within a slot, to the grooves in a channel of respective metal bars.

* * * * *